US005126755A

United States Patent [19]

Sharpe et al.

[11] Patent Number: 5,126,755

[45] Date of Patent: Jun. 30, 1992

[54] PRINT HEAD ASSEMBLY FOR INK JET PRINTER

[75] Inventors: Colin R. Sharpe, Chicago; Robert I. Keur, Niles, both of Ill.

[73] Assignee: Videojet Systems International, Inc., Wooddale, Ill.

[21] Appl. No.: 675,987

[22] Filed: Mar. 26, 1991

[51] Int. Cl.[5] ..... B41J 2/04

[52] U.S. Cl. ..... 346/75; 346/140 R

[58] Field of Search ..... 346/75, 140 R; 251/129.17, 129.2, 231

[56] References Cited

U.S. PATENT DOCUMENTS

| | | | |
|---|---|---|---|
| 960,757 | 6/1910 | Wilson | 251/129.2 |
| 1,392,952 | 10/1921 | Link | 251/129.2 |
| 3,570,807 | 3/1971 | Sturman et al. | 251/129.17 |
| 3,662,399 | 5/1972 | Yanou et al. | 346/140 IJ |
| 4,120,481 | 10/1978 | von Koch | 251/129.17 |
| 4,383,264 | 5/1983 | Lewis | 346/140 R |
| 4,397,336 | 8/1923 | Godfrey | 251/231 |
| 4,539,570 | 9/1985 | Moore | 346/75 |
| 4,576,111 | 3/1986 | Slomianny | 346/140 R X |
| 4,723,131 | 2/1988 | Droit | 346/75 |
| 4,809,017 | 2/1989 | Fost | 346/75 |
| 4,823,149 | 4/1989 | Martner et al. | 346/140 R |
| 4,928,111 | 5/1990 | Walton | 346/1.1 |

FOREIGN PATENT DOCUMENTS

WO8501103 3/1985 European Pat. Off. .

*Primary Examiner*—George H. Miller, Jr.
*Assistant Examiner*—Alrick Bobb
*Attorney, Agent, or Firm*—Rockey and Rifkin

[57] ABSTRACT

An element for a drop on demand ink jet printer employing a lever seal in a housing to control the frequency and quantity of ink delivered to a printing material such as paper.

6 Claims, 2 Drawing Sheets

FIG.3
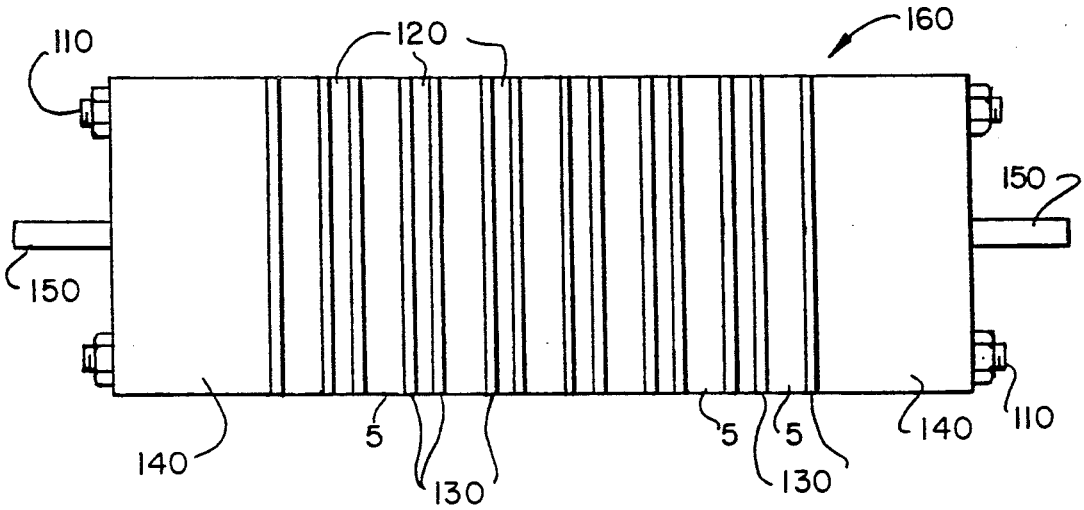
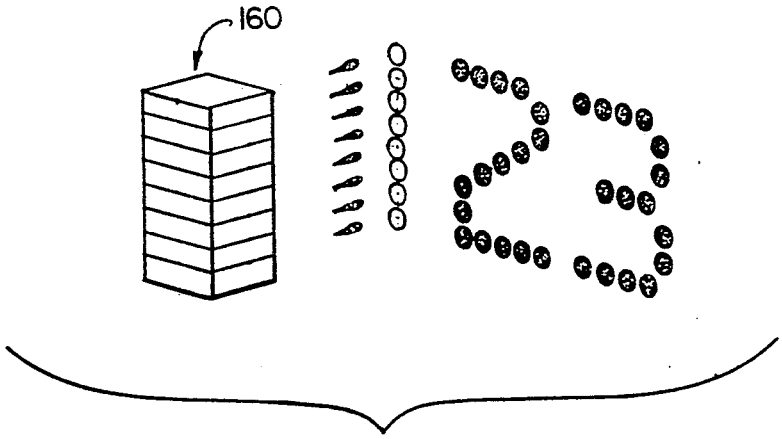
FIG.4

PRINT HEAD ASSEMBLY FOR INK JET PRINTER

The present invention relates to a valve and print head assembly employed in a "drop on demand" ink jet printing device.

BACKGROUND OF THE INVENTION

Numerous drop on demand printing devices, which deliver ink droplets to paper or other material to be marked, are well known. Such mechanisms include, for example, remote solenoid valves feeding nozzles through a length of tubing, solenoid valves operating at the nozzle, and solenoids operating via flexible or rigid cable. See, for example, U.S. Pat. Nos. 4,723,131, 4,576,111 and 4,809,017. These systems produce large drops suitable for large character printing such as that employed on cardboard cartons.

Another example of a prior art valve device is shown in PCT International Publication No. WO 85/01103, published Mar. 14, 1985. In that device, a coil driven magnetic reed operates as a valve for opening an closing an ink chamber, thereby dispensing drops of ink upon actuation of the valve.

Devices such as those described suffer from a number of problems. An important problem related to remote solenoid devices is the low frequency response of the valve/nozzle assembly due to slow valve action, causing long filaments of ink to be ejected from the nozzle. Other problems found in earlier systems include the ingestion of air into the nozzle, causing printing errors, and high power requirements for actuating the solenoid driven valve drivers.

Proximate valve assemblies, and assemblies employing cables between a solenoid and the ink delivery nozzle have encountered reliability problems. In addition, the high manufacturing costs associated with such devices, and low frequency response problems like that described above, have limited the acceptance of such devices.

Another type of valve assembly is used in small character printers (such as document printers). Such devices use the surface tension at the orifice of the nozzle to provide the function of a valve. This surface tension absorbs the recoil of the ink drop to stop leakage from the orifice. A small orifice (typically less than 60 microns) must be used, and the surface tension of the ink must be high, to prevent leakage. Such systems have not proved suitable for large character printers which require larger ink drops.

Another problem found in many of the previously described systems is contact between the ink and the valve actuating device. In systems where such contact is permitted, the composition of the ink is required to be non-corrosive to limit the damage caused by such contact.

SUMMARY OF THE INVENTION

The present invention overcomes the problems found in previous ink jet delivery systems by providing a corrosion resistant valve in which the ink is isolated from the actuating devices such as solenoids. A relatively high frequency response is produced as a result of simple mechanical linkages actuating the valve. In addition, the valve is simple to construct, and each valve may be readily combined with other valves to produce a print head array capable of generating large or small characters. Moreover, since the utility of the valve is not limited to a small orifice size or to ink having a high surface tension, drop size may be varied to obtain the desired printing effect with few structural limitations.

Thus, the present invention provides a valve assembly for a drop on demand ink jet printer comprising a housing defining an ink chamber, in which a conduit for ejecting ink from the valve is formed in the housing and ends in an orifice in the housing wall. A lever is pivotally connected to the housing, which lever has an interior end disposed in the ink chamber. The lever includes a means for sealing and unsealing the conduit, so that ink is ejected when the conduit is unsealed.

The present invention also relates to a print head assembled from a plurality of such valves spaced apart from one another such that the array of valves may be employed to print a pattern corresponding to an alphanumeric or other character or graphic design.

BRIEF DESCRIPTION OF THE DRAWINGS

FIG. 3 shows a front view of a plurality of such valves assembled into a print head according to the present invention.

FIG. 4 shows a plurality of valves assembled into an array for printing characters, in accord with the present invention.

DETAILED DESCRIPTION OF THE INVENTION

Figure 1:
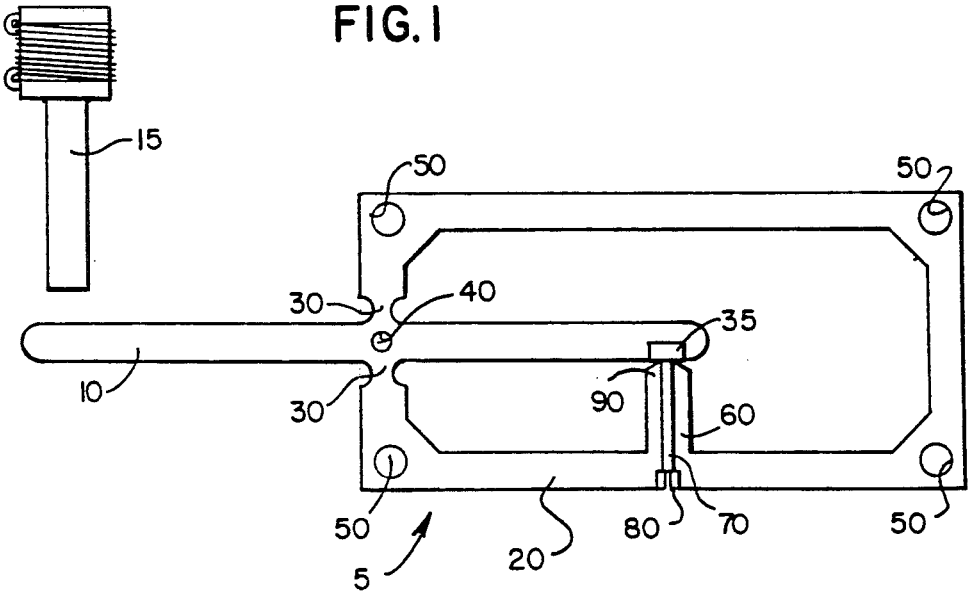
FIG. 1 shows a sectional view of the valve of the present invention.

Referring to FIG. 1, a valve 5 is provided that includes an actuating lever 10 flexibly connected to the housing 20 at neck portions 30. Lever 10, housing 20 and neck 30 are preferably an integral assembly that is made from a suitable material, such as plastic, corrosion resistant metal or epoxy, which permits the lever to rotate in response to force applied at the external end. For ease of manufacture, this assembly is preferably made from injection molded plastic; it may, however, be die cut, etched, laser cut, or made by any other means. Neck portions 30 are notched or molded into housing 20, and are of such dimensions as to permit rotation of lever 1.

Figure 2:
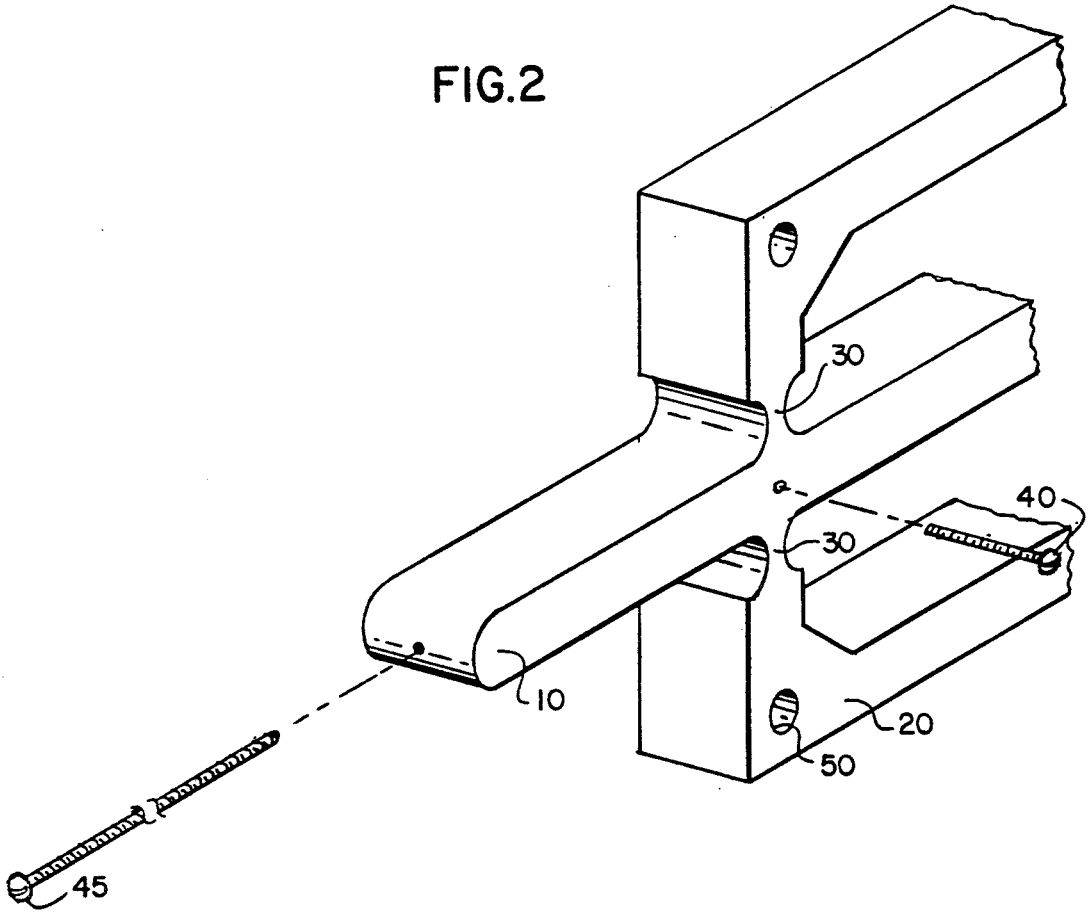
FIG. 2 is a partial perspective view of the valve, showing two optional modifications of the valve to enhance stability and operation.

As shown in FIG. 2, lever 10 may optionally be provided with a fulcrum pin 40 along the rotational axis of lever 10 to impart stability at the point about which rotation occurs. Alternatively, a pin 45 may be inserted along the longitudinal axis of lever 10 to impart rigidity along the length of the lever, thereby ensuring that displacement of the outside end of lever 10 results in similar displacement of the inside end of lever 10. A pin having both horizontal and vertical components may also be molded in place at the intersection of lever 10 and neck portions 30. Such a longitudinal pin would be at least long enough to pass from the exterior end of the lever 10 to beyond the rotational axis of lever 10.

Returning to FIG. 1, lever 10 may be fitted with a seal 35 at its end disposed inside housing 20. This seal preferably is made of an elastomer, but may be made of any ink-resistant material that will provide a good seal when ink flow is not desired.

Housing 20 is provided with a conduit 60, which is preferably an integral assembly with housing 20. Conduit 60 includes bore 70 to permit ink to flow out through the valve via orifice 80. Lever 10 and conduit 60 are disposed such that seal 35 rests snugly on a valve seat 90 formed on the end of conduit 60 when the lever is not displaced therefrom.

In use, upon actuation by an external device 15, such as a solenoid, cable, mechanical linkage, pneumatic, hydraulic, or piezoelectric means, lever 10 pivots about its rotational axis. For example, a solenoid may be operably connected, by mechanical, adhesive or other means, to the end of lever 10 disposed outside the valve. When delivery of ink from the valve is required, the solenoid may be actuated to move lever 10 downwardly. This downward motion on the exterior portion of the lever causes the interior portion to be raised, unsealing the conduit 60.

Upon actuation of lever 10, ink, flows through the valve under pressure (typically, but not necessarily, at or below 10 psi, and preferably below 5 psi) and exits the valve through conduit 60 and orifice 80. The pressure head may be supplied by a pump or by a pressurized ink cartridge, or by other means. Bore 70 may optionally be fitted with an insert, such as a metal or ceramic tube and/or a jeweled orifice to enhance the flow of ink through the conduit.

It is important to note that this operation is different from the operation of conventional valves. In conventional devices, ink is released by the valve as a consequence of mechanical displacement. For example, the valve may take the form of a flexible membrane as shown in U.S. Pat. Nos. 4,383,264 and 4,723,131. In such valves, a membrane is flexed to push ink through an orifice, and retracted to permit additional ink to be received for printing upon the next flexure. The present invention does not employ such a technique. Instead, the ink chamber is under substantially constant pressure. When conduit 60 is unsealed, ink flows out in response to such pressure. Immediately thereafter, reseating of the seal 35 on conduit 60 terminates ink flow, resulting in the formation of an individual drop.

The stream of ink exiting orifice 80 forms a drop which travels to the substrate to be marked. In combination, such dots form patterns corresponding to letters, numbers, symbols, or graphic designs and patterns. The size of the dot will depend upon drop size, which is a function of the amount of time the seal is unseated, the ink pressure, the ink composition and the orifice size. It is understood by those skilled in the art that the adjustment of such variables will be dependent upon the image to be printed, and that they may be readily determined from available data.

In an ideal setting, the ink pressure forces a cylinder of ink out of the orifice 80 when the valve seal is opened, terminating upon the reseating of seal 35. The actual effect of the closing of the valve is to produce a teardrop-shaped ink drop as a result of the varying celerity C of the ink in the cylinder. The volume of this drop for an orifice of diameter D may be calculated as follows:

$$V_{cylinder} = \frac{\pi}{4} D^2 L \qquad \text{(I)}$$

wherein the length of the cylinder L is equal to the average celerity C of the ink multiplied by the time T over which the valve seal is open. Substituting these values for L, Equation I may therefore be rewritten as:

$$V_{cylinder} = \frac{\pi}{4} D^2 CT \qquad \text{(II)}$$

Since the volume of the drop is roughly equal to the volume of the cylinder, the volume of ink in the drop may adequately be represented by Equation II.

The time T over which the seal is open, may be controlled using electronic apparatus, with an increase in time resulting in a change of fluid cylinder length and concomitantly ink drop volume. The celerity C of the ink will vary as a function of ink pressure; thus, as the ink pressure is increased, the celerity of the ink increases, as does the size of the drop. Adjustment of these two variables, along with the ink viscosity may be made to produce drops of the desired size. Typical variables will be as set forth in Table I.

TABLE I

| | |
|---|---|
| Orifice Size: | 120–300μ |
| Ink Pressure: | 3–5 psi |
| Celerity: | 300–600 cm/s |
| Time: | 1 ms |
| Viscosity: | 1.5–5 cp |

Housing 20 is closed on four ends, but open on both sides to receive ink under pressure from a common supply. An assembly of a plurality of such valves form a print head as shown in FIG. 3. To accomplish such an assembly, mounting holes 50 (shown in FIG. 1) are provided in housing 20 to permit linkage of a plurality of valves.

FIG. 3 shows a plurality of valves 5 assembled as an array 160 contemplated by the invention. The valves are joined to on another via connection pins 110. Each valve is separated from an adjacent valve by a spacer 120 and a gasket 130. The spacers are preferably made from a rigid material, such as metal or rigid plastic, while the gaskets are preferably made from a resilient material such as an elastomer. It may also be desirable to combine the spacers and gaskets into a single component. Holes are provided in each spacer and gasket to permit the connector pins 110 to extend through them. The valve assembly of FIG. 3 also includes end plates 140 to seal the sides of the valves at each end of the print head, thereby defining an enclosed ink chamber. A gasket 130 is preferably placed between each end plate 140 and its adjacent valve 5 to provide a seal. End plates 140 also include inlet and bleed ports 150 to permit flow of ink, under pressure, into and out of the valve assembly.

Spacers 120 are sized to provide sufficient distance between the valves that ink flowing through the orifice of each valve produces a dot on the printing material that is separate and distinct from dots produced by other valves in the assembly. At the same time, the valves will not ordinarily be spaced so far apart as to produce patterns of dots that cannot be seen to form a character or symbol by the ordinary observer.

The number of valves used in the assembly as shown in FIG. 3 should be sufficient to form the desired image size when printed. Among the factors to be considered in this determination are the size of orifice 80, the corresponding dot size printed on the paper, the type and viscosity of the ink used, and the characteristics of the desired image. Those skilled in the art are readily able to make this determination.

For example, an assembly of seven valves would produce a single line of a seven-dot high printing matrix, as shown in FIG. 4. Additional valves may be employed to produce multiple lines of characters or larger characters.

The present invention has been described with respect to certain embodiments and conditions, which are not meant to and should not be construed to limit the invention. Those skilled in the art will understand that variations from the embodiments and conditions described herein may be made without departing from the invention as claimed in the appended claims.

What is claimed is:

1. An element for use in forming a print head comprised of a plurality of such elements for a drop on demand ink jet printer comprising:

a) a housing having end walls but no sides defining an internal space for receiving a pressurized ink supply;

b) a conduit formed in an end wall of the housing and having an orifice for permitting ink drops to issue therefrom;

c) an elongated lever arm pivotally secured to an end wall of said housing, said lever arm including: (1) a first end disposed within said housing; (2) a second end extending externally of said housing and (3) means disposed on said first end for sealing said conduit to prevent ink from issuing from said orifice d) means for periodically pivoting said lever arm to unseal said conduit, thereby to permit ink to issue from said orifice.

2. The element according to claim 1 wherein said lever arm is formed as an integral part of said housing end wall.

3. The element of claim 1 wherein said lever arm pivots about the point where said lever arm joins the housing end wall, said end wall having a fulcrum pin inserted therein to reinforce the pivot point.

4. The element of claim 1 wherein said conduit further includes an insert to enhance ink flow therethrough.

5. A print head assembly for a drop on demand ink jet printer comprising:

a) a plurality of elements each including:

i) a housing having end walls, but no sides defining an internal space for receiving a pressurized ink supply;

ii) a conduit formed in an end wall of the housing and having an orifice for permitting ink drops to issue therefrom;

iii) an elongated lever arm pivotally secured to an end wall of said housing, said lever arm having a first end disposed within said housing and having means for sealing said conduit to prevent ink from issuing from said orifice and a second end extending externally of said housing;

b) end plates disposed at opposite ends of said assembly; said end plates including ports for the inflow or outflow of ink;

c) means for securing said elements and end plates together to form a print head assembly with an internal reservoir; and d) actuating means for pivoting selected ones of each said lever arm to unseal said conduits to permit ink to flow there through, said actuating means being operable independently of one another.

6. The print head assembly of claim 5, further including spacing means interposed between the elements, said spacing means including resilient seals to prevent leakage.

* * * * *